United States Patent [19]

Knapp et al.

[11] 4,131,314

[45] Dec. 26, 1978

[54] SEATING FURNITURE

[75] Inventors: Robert L. Knapp, Grand Rapids; Leif Blodee, Holland; William R. Van Loo, Grand Rapids, all of Mich.

[73] Assignee: American Seating Company, Grand Rapids, Mich.

[21] Appl. No.: 849,892

[22] Filed: Nov. 9, 1977

Related U.S. Application Data

[62] Division of Ser. No. 774,230, Mar. 4, 1977, abandoned.

[51] Int. Cl.[2] ..... A47C 15/00

[52] U.S. Cl. ..... 297/248; 108/64; 297/440; 297/445; 297/455; 297/460; 297/DIG. 1

[58] Field of Search ..... 108/64; 206/430, 504; 220/23.4; 297/248, 249; 312/111

[56] References Cited

U.S. PATENT DOCUMENTS

| | | | |
|---|---|---|---|
| 2,305,183 | 12/1942 | Mehr | 297/248 X |
| 2,566,804 | 9/1951 | La Flamme et al. | 220/23.4 X |
| 3,877,764 | 4/1975 | Hillier | 312/111 X |
| 3,944,281 | 3/1976 | Piretti | 297/248 X |

FOREIGN PATENT DOCUMENTS

| | | | |
|---|---|---|---|
| 1359212 | 3/1964 | France | 108/64 |

*Primary Examiner*—James C. Mitchell

*Attorney, Agent, or Firm*—Emrich, Root, O'Keeffe & Lee

[57] ABSTRACT

A chair is formed from two side frame sections each including a tubular frame and leg assembly with expanded metal secured to it. The side sections are encapsulated in foam which adheres to and completely encompasses the expanded metal. A seat cushion and foamed front skirt are added to the foamed side frame sections. A flat skirt is provided to completely follow the periphery of the chair just above the floor; and two chairs may be joined at any desired orientation relative to each other by a doubly-grooved joinder member coupling the lower peripheral metal skirts together.

2 Claims, 17 Drawing Figures

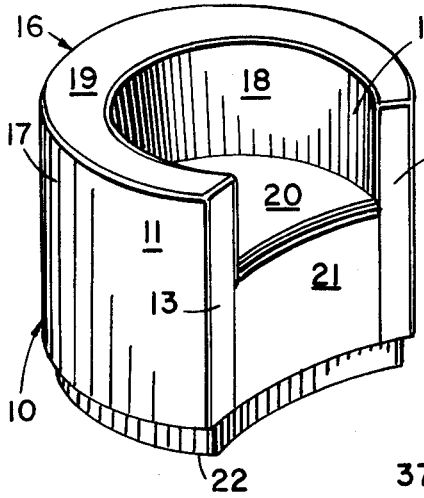
Fig. 1
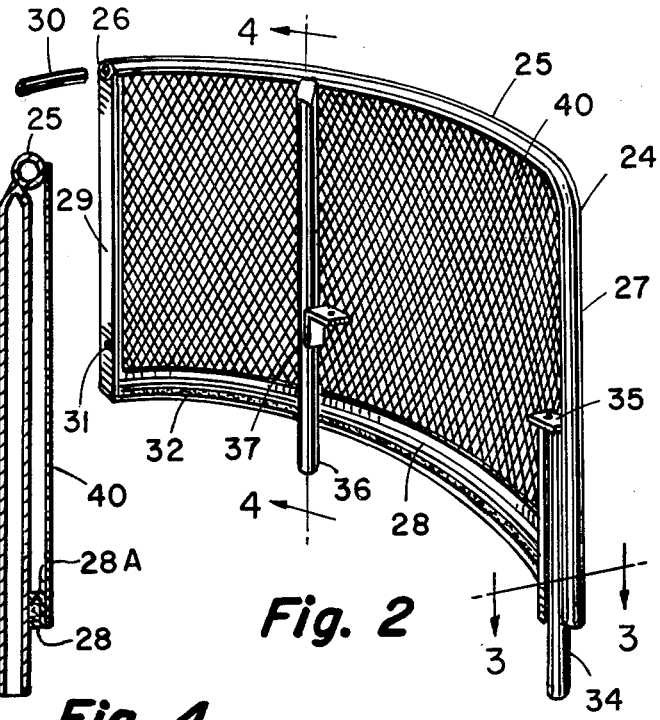
Fig. 2
Fig. 4
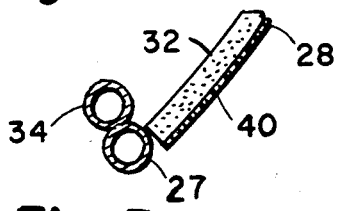
Fig. 3
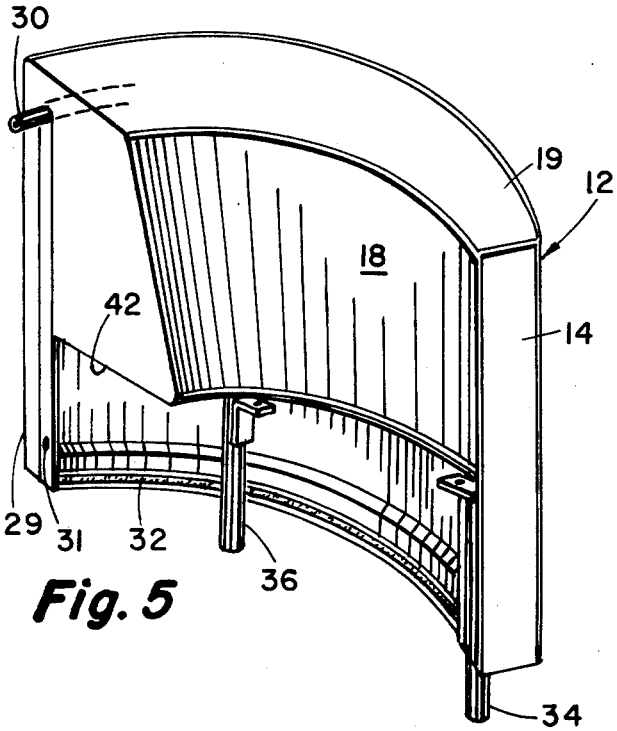
Fig. 5
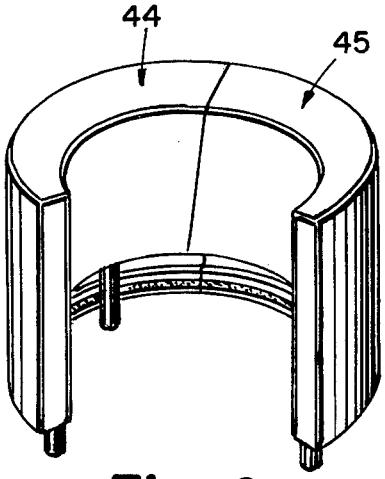
Fig. 6

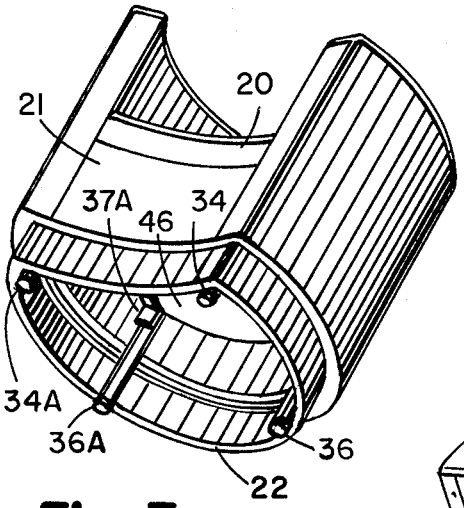
Fig. 7
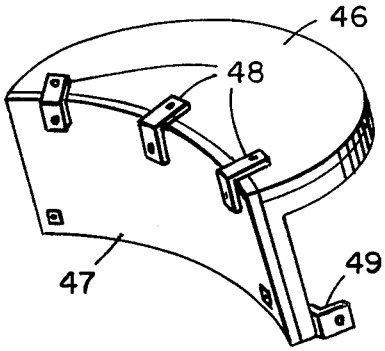
Fig. 8
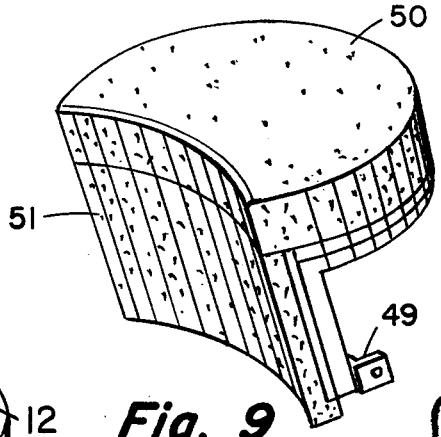
Fig. 9
Fig. 10
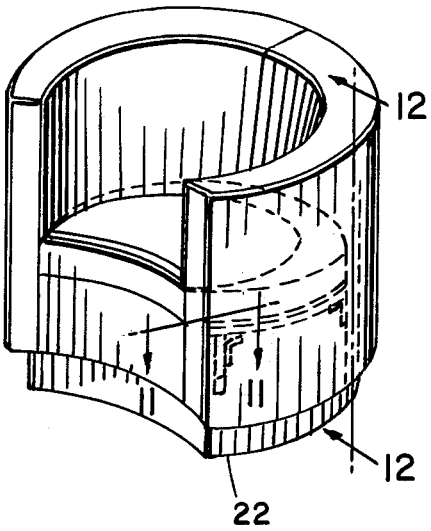
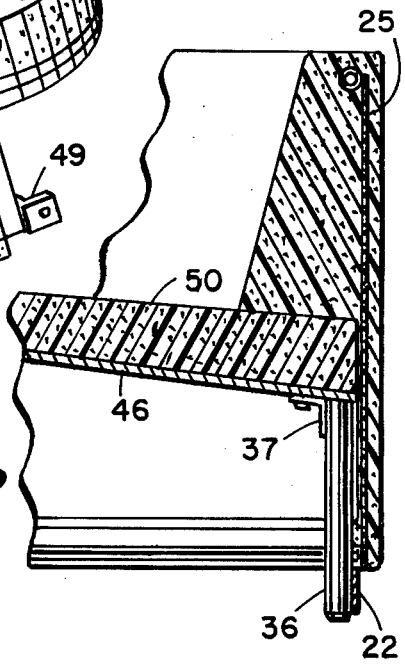
Fig. 12
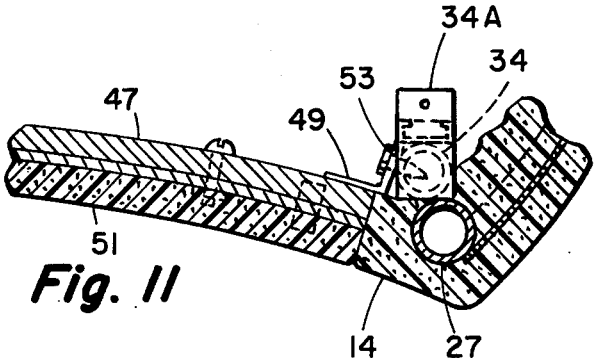
Fig. 11

SEATING FURNITURE

This is a division; of application serial no. 774,230, filed Mar. 4, 1977 now abandoned.

BACKGROUND AND SUMMARY

The present invention relates to furniture adapted to provide seating for individuals. Although the illustrated embodiment is in the form of a chair for a single individual, the invention has a broader application. The invention has particular utility, however, in providing seating which has a flexible foam throughout substantially the entire exterior so as to provide a softness and feeling of comfort to the touch. Further, in the case of chairs, individual units may be joined together into a cluster such that any two chairs may assume a broad range of orientation relative to each other, thereby providing flexibility and modularity in the grouping of chairs.

Individual chairs have been grouped together as disclosed in U.S. Pat. No. 3,955,850. Further, furniture has been formed by placing a tubular frame into a mold and introducing foam polyurethane into the closed molds, see U.S. Pat. Nos. 3,258,511 and 2,838,100. Strips of mesh or gridwork formed from expanded metal have been used to provide foam cushions which may be formed to any desired shape by bending the metal, as in U.S. Pat. No. 3,289,224.

SUMMARY OF THE INVENTION

Although the illustrated embodiment and subsequent description are directed to a chair, as indicated above, persons skilled in the art will realize that the present invention has broader application. In the illustrated embodiment, a chair is formed from two side frame sections each including a tubular frame and leg assembly. Each frame and leg assembly provides a front and a rear leg, and a rear joinder section for joining to a complementary side frame section after foaming.

Expanded metal is secured to a frame and leg assembly. The side sections are then encapsulated in foam such as polyurethane, which is soft and flexible when it is cured. The foam adheres to and completely encompasses the expanded metal, as well as substantially all of the frame and leg assembly except for the exposed lower portions of the legs and the joinder elements.

The foamed side sections are joined together at the rear to complete the back and sides of the chair which may be curved in a continuous fashion, both inside and out, and formed to define a generally horizontal arm rest which continues at the same horizontal level around the back of the chair to the other arm rest.

The foam is formed in such a manner as to provide an overhanging cushion at the inner upper portion of each side frame section to extend above a seat cushion when it is assembled to the structure.

A seat cushion and front skirt panel assembly are attached to the side frame sections to provide an exterior of the chair which is substantially entirely upholstered foam.

A flat metal skirt is provided to completely follow the periphery of the chair just above the floor. Two chairs may be joined at any desired orientation relative to each other by a doubly-grooved joinder member coupling the lower peripheral skirts together. And a number of chairs may thus be joined together in a cluster or grouping.

Other features and advantages of the present invention will be apparent to persons skilled in the art from the following detailed description of a preferred embodiment accompanied by the attached drawing wherein identical reference numerals will refer to like parts in the various views,

THE DRAWING

FIG. 1 is an upper right frontal perspective view of a finished chair constructed according to the present invention;

FIG. 2 is a frontal perspective view of a left side frame section employed in the chair of FIG. 1;

FIG. 3 is a horizontal cross sectional fragmentary view of the lower front portion of the side section of FIG. 2 taken along the sight line 3—3 thereof;

FIG. 4 is a vertical cross sectional view taken through the sight line 4—4 of FIG. 2;

FIG. 5 is a view similar to FIG. 2 of a completed side frame section after the foam is applied;

FIG. 6 is an upper frontal perspective view of complementary side sections in assembled relation;

FIG. 7 is a lower left side perspective view of the chair of FIG. 1;

FIG. 8 is an upper left front perspective view of a seat support and front skirt support in assembled relation;

FIG. 9 is a view similar to FIG. 8 with the foam cushion applied;

FIG. 10 is an upper left frontal perspective view of a completed chair with the seat cushion shown in phantom;

FIG. 11 is a fragmentary horizontal cross sectional view of the left front corner of the chair of FIG. 10 taken through the sight line 11—11 thereof;

FIG. 12 is a vertical cross sectional view of the chair of FIG. 10 taken through the sight line 12—12 thereof;

DETAILED DESCRIPTION

Figure 13:
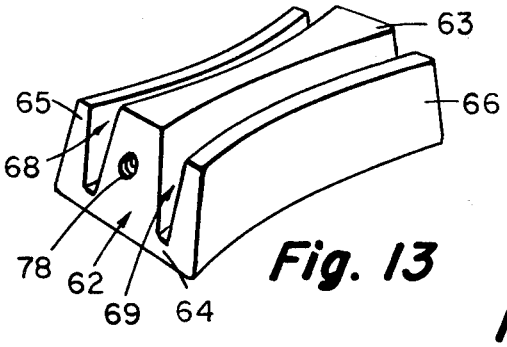
FIG. 13 is an upper perspective view of a coupler for connecting two chairs together.

Referring first to FIG. 1, a chair constructed according to the present invention is generally designated by reference numeral 10. It is deemed that the construction and structure of the chair 10 will be better understood if the design, form and structure is first appreciated. The chair 10 includes first and second sides 11, 12 which form arm rests. The sides are curved about from respective front panels 13, 14 to form a continuous back generally designated 16. Thus, the sides and back are defined by an outer cylindrical surface 17, and inner surface 18, of inverted, slightly conical shape, and a generally horizontal, flat upper surface 19.

The chair also includes a seat 20 and a slightly concavely curved front skirt 21. The inner surface 18 of the integral back and side structure is slightly outwardly inclined as it extends upwardly from the seat 20. A lower peripheral skirt 22, which may be formed from sheet metal or equivalent extends about the entire periphery of the chair just above the floor. Other designs, seating functions, and forms could equally well be manufactured, but the present invention is particularly suited to providing seating structure wherein substantially the entire exterior surface is upholstered foam to provide a soft, compressible structure comfortable in use.

Turning now to FIGS. 2–5, the side and back structure of the chair 10 is formed by left and right side sections which are joined together. The left side section (from the viewpoint of one sitting in the chair) will now be described. A tubular frame generally designated 24 includes a first tubular element 25 which extends from the center of the back of the finished chair designated 26 around to the front, to form the upper portion of the left arm 12, and thence downwardly to form a front vertical portion 27 adjacent the front panel 14. A curved metal channel 28 extends along the bottom of the side frame member from a location adjacent the bottom of the front element 27 to the bottom of a vertical angle iron 29, the upper part of which is welded to the bottom of the curved upper frame element 25 leaving the end open to receive a joinder tube (see tube 30 in FIG. 2) for joining the upper sections of the two side frame and leg assemblies together. The joinder tube 30 is secured within each tubular frame at the rear by means of screws. The angle iron 29 is apertured at 31 for joining the lower sections of two side frame and leg assemblies after they are foamed, as will be described. A slight pocket is formed in the foam to permit access to these apertures.

The channel 28 has an opening which extends inwardly, and the channel is filled with jute 32, as in a conventional tacking strip. A front tubular leg element 34 is welded to the rear side of the forward frame element 27, and it is provided with a horizontal bracket 35 at its top, which is located just beneath the seat 20. The bracket 35 is used to attach a seat panel, as will be described. A vertical tacking strip 34A is located on the front leg 34 for securing the upholstery which is wrapped around the sides of the chair. A rear tubular leg 36 is welded both to the curved channel 28 and to the curved upper frame element 25, and it also is provided with a bracket 37 to which a seat panel is ultimately secured. It will thus be appreciated that an enclosed rigid frame comprising top and bottom (25, 28) and front and rear (27, 29) frame elements is provided. A sheet of expanded metal 40 spans the opening in the frame and is welded to the elements of the rigid side frame and leg assembly.

In the finished construction, the closed rigid framework prevents movement of the periphery of the bendable expanded metal 40, and the expanded metal permits foam to permeate it and thereby enclose substantially the entire frame and leg assembly, while adding strength to the foam to resist puncture or depression beyond the stretch limits of the covering foam layer. Diamond-patterned expanded metal having a thickness of 0.050 in. and open area in the range of 50–55% may be used, but persons skilled in the art will appreciate that other types of expanded metal or metal gridwork may equally well be employed.

Referring now to FIGS. 3 and 4, the lower edge of the expanded metal 40 may be secured directly to the web of the channel 28, or it may be welded to spaced flanges, such as that designated 28A in FIG. 4.

The tubular metal frame and expanded metal as illustrated in FIG. 2 and just described is then placed in a mold with the lower portions of the legs exposed, and foam is introduced into the mold and permitted to expand into the mold cavity, substantially completely encapsulating the rigid frame and the expanded metal, and forming the shape illustrated in FIG. 5 for the left side of the chair. It will be observed from FIG. 5 that the forwardly turned edge of the angle iron 29 is accessible for joining the two halves, and that the foam is permitted to expand about the tacking strip, but to leave the jute 32 exposed for attaching the lower edge of the upholstery to be applied. Polyurethane foam will adhere to the metal frame and gridwork, but other foams may also be employed.

It will be observed that a substantial overhang as at 42 is formed by the back portion of the cushion. The overhang narrows continuously proceeding from the center of the back to the forward panel 14. The overhang 42 extends above the seat cushion 20 in the final assembly, and defines the shape of the surface 18, previously described. It has been found advantageous to place the side frame and leg assemblies in their respective molds such that the expanded metal 40 is located approximately one inch in from the outer surface 11 of the finished product. This has been found to provide a soft, comfortable touch, yet a sufficient resistance to kicking or deep probing which might destroy the chair or the upholstery fabric.

The right side of the chair is complementary to the left side which has just been described, and it is similar in structure, so it need not be further described for a complete understanding of the invention. The two sides are joined together by bolts passing through the apertures 30, 31 (and corresponding apertures on the facing flange of the rigid frame of the other side). The two side sections thus joined form the structure shown in FIG. 6, the right side of the chair being generally designated by reference numeral 44, and the left side being generally designated 45.

Referring now to FIGS. 8 and 9, a crescent-shaped rigid seat panel, which may be made from plywood, is designated 46, and it is secured to a front skirt panel 47 by means of angle brackets 48. The front skirt panel 47 is of a general concave (i.e. cylindrical) shape to provide leg room for an occupant. An angle bracket (see the one designated 49) is provided at the lower rear edge of each side of the skirt panel 47. The assembly shown in FIG. 8 is then fitted with a seat cushion 50 and a front skirt cushion 51 as seen in FIG. 9, and upholstery is then applied, the edges of the upholstery being secured to the undersurface of the seat panel 46 and the rear surface of the skirt panel 47. The seat and front skirt assembly is secured to the side chair sections 44, 45 by means of the brackets (37, 37A) on the rear legs of the chair 36, 36A, as indicated in FIGS. 2 and 7, and by similar brackets on the front legs 34, 34A (one bracket being designated 35 in FIG. 2). As illustrated in FIG. 12, the rear section of the seat panel 46 which is supported by the brackets 37 and 37A is inclined downwardly for comfort, and the lower portion of the back cushion extends forwardly, also for comfort.

Turning now to FIG. 11, the lower side edges of the skirt panel 47 are secured by the brackets (the one illustrated being designated 47) which are secured by sheet metal screws (see the one designated 53 in FIG. 11) to their associated front leg elements.

Figure 14:
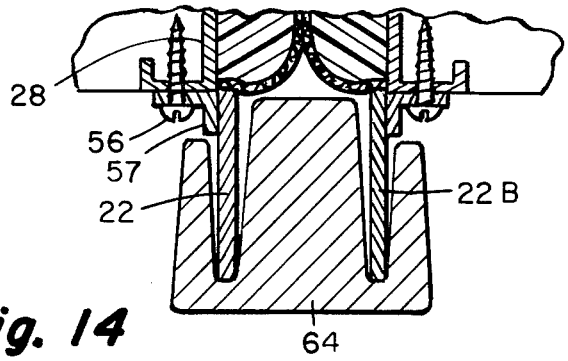
FIG. 14 is a transverse vertical cross sectional view through a coupler connecting two adjacent chairs together with the chairs in fragmentary form.
Figure 16:
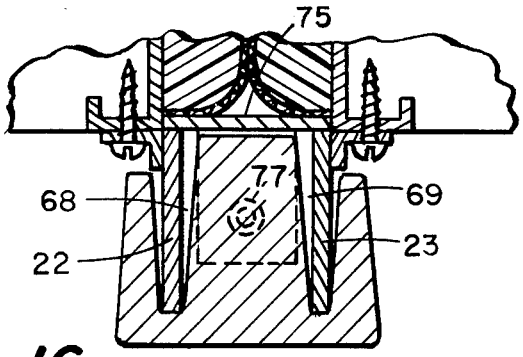
FIG. 16 is a view similar to FIG. 14 illustrating the use of the T-flanges of FIG. 15.

Referring now to FIGS. 1, 7 and 12, the lower peripheral skirt 22 can be seen to extend about the legs 34, 34A, 36 and 36A to follow the contour of the chair, spaced slightly inwardly from its marginal edge. It is secured to the lower flange of the channel 28 by means of metal screws 56 and brackets 57, as best seen in FIGS. 14 and 16. The lower peripheral skirt 22 serves to at least partially hide the legs of the chair, and it also serves a function in connecting the chairs.

Turning now to FIGS. 13 and 14, a connecting member or casting is generally designated by reference numeral 62, and it includes an elongated central portion 63, a base 64 and first and second side members 65, 66. The side members 65, 66 are spaced from the central member 63 so as to define first and second curved slots 68, 69. The curvature of the slots 68, 69 is such as to conform to the curvature of the peripheral skirt 22 of the chair (that is, that portion of the skirt 22 located beneath the arms or back of the chair). As seen in FIG. 14, when the connecting element 62 is coupled to the peripheral skirts 22, 22B of two different chairs, the chairs cannot move sideways relative to each other. The spacing of the slots 68, 69 is such that in order for the skirts 22, 22B to fit into them, the outer portion of the contacting foam is slightly compressed, thereby increasing the friction between the two chairs and reducing the tendency of the chairs to rotate in the connecting member 64.

Figure 15:
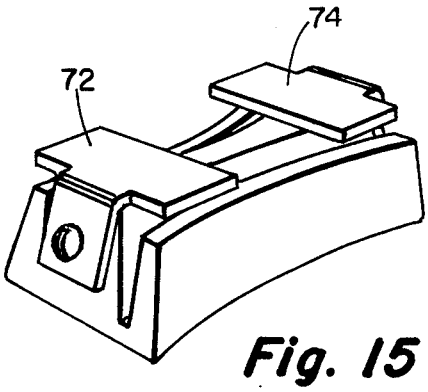
FIG. 15 is a view similar to FIG. 13 with T-flanges for more permanently connecting chairs together.

If additional positive coupling is required, T-shaped block members 72, 74 in FIG. 15 may be used. The block members 72, 74 have a general T-shape, but they are bent about a line immediately beneath the cross member which forms a transverse flange dimensioned to fit above the peripheral skirts 22, 22B when they are received in the slots 68, 69 as seen in FIG. 16. The flange is designated by reference numeral 75, and the base of the lock member is secured to the connecting block 62 by means of a screw 77 received in a tabbed aperture, one of which is designated 78 in FIG. 13.

Figure 17:
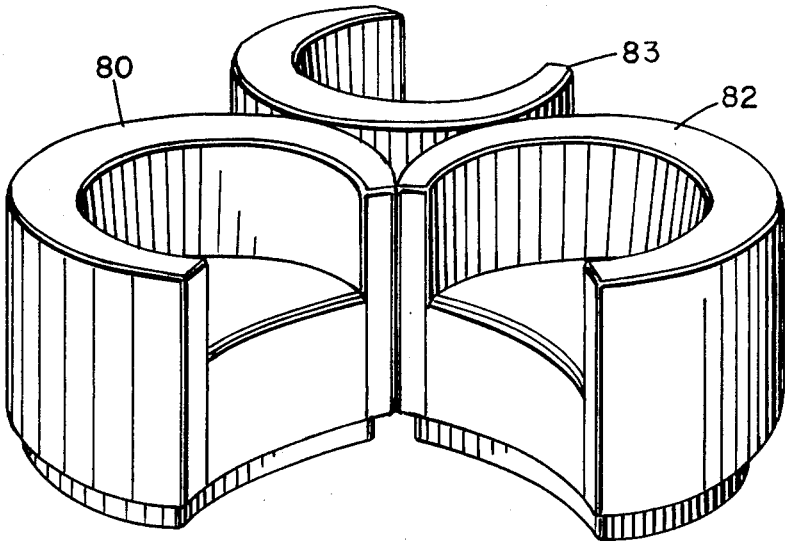
FIG. 17 is an upper perspective view showing three chairs constructed according to the present invention connected together in a grouping.

With this connecting structure, the individual chairs may be oriented at any desired angle relative to each other and connected together, such as illustrated in FIG. 17 where the facing chairs 80, 82 are connected to the chair 83 located to face another direction. Additional chairs could be connected to any of the chairs indicated, and a cluster or grouping could be extended indefinitely. Further, the structure locking adjacent chairs together is simple enough that they may be rearranged conveniently and without the need of skilled help.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination, first and second furniture elements, each including a lower skirt of rigid sheet material formed to define a uniform curvature over a major portion thereof, said skirt being disposed such that its width extends vertically; a joinder member including a base adapted to rest on a floor and defining first and second elongated slots conforming to said uniform curvature of said skirts and adapted to receive the same in side-by-side relation; and means for locking said skirts into said slots, said locking means including a flanged element removable from said joinder member and extending above both skirts when said flanged element is secured to said joinder member and said skirts are received in said slots to hold said skirts in their respective slots by preventing said skirts from being withdrawn vertically from their associated slots.

2. The apparatus of claim 1 wherein said furniture elements include support legs, and wherein said skirts are attached adjacent the bottom of said legs and extend over a majority of the periphery of said units in uniform curvature, whereby each unit may assume a wide range of random orientation relation to adjacent units by attachment to said skirt at any position of said skirts having said uniform curvature.

* * * * *